United States Patent [19]

Hundertmark

[11] Patent Number: 4,836,506

[45] Date of Patent: Jun. 6, 1989

[54] VALVE CONTROL FOR BACK DRAFT CARBURETOR

[75] Inventor: James M. Hundertmark, Fond du Lac, Wis.

[73] Assignee: Brunswick Corporation, Skokie, Ill.

[21] Appl. No.: 176,853

[22] Filed: Apr. 4, 1988

[51] Int. Cl.[4] ..... F02M 5/08

[52] U.S. Cl. ..... 261/23.2; 261/72.1; 261/DIG. 67

[58] Field of Search ..... 261/DIG. 67, 23.2, 72.1

[56] References Cited

U.S. PATENT DOCUMENTS

| | | | |
|---|---|---|---|
| 1,010,184 | 11/1911 | Schulz | 261/DIG. 67 |
| 2,029,142 | 1/1936 | Wemhoner | 261/DIG. 67 |
| 2,701,709 | 2/1955 | Brunner | 261/DIG. 67 |
| 3,058,728 | 10/1962 | Ruth | 261/DIG. 67 |
| 3,307,837 | 3/1967 | Winkler | 261/DIG. 67 |
| 3,796,413 | 3/1974 | Woods | 261/23.2 |
| 3,831,910 | 8/1974 | Shadbolt | 261/DIG. 67 |
| 4,040,399 | 8/1977 | Meininger | 261/DIG. 67 |
| 4,283,356 | 8/1981 | Arai et al. | 261/DIG. 67 |
| 4,376,738 | 3/1983 | Reinmuth | 261/DIG. 67 |

FOREIGN PATENT DOCUMENTS

| | | | |
|---|---|---|---|
| 848437 | 9/1952 | France | 261/DIG. 67 |

*Primary Examiner*—Tim Miles

*Attorney, Agent, or Firm*—Andrus, Sceales, Starke & Sawall

[57] ABSTRACT

A back draft carburetor of the type in which a vacuum source in the throat of a carburetor is communicated to the air space above the fuel in the float bowl of the carburetor includes a valve disposed between the vacuum source and the float bowl. At low vacuum levels in the carburetor throat, the valve is in a closed position in which the vacuum in the carburetor is sealed off from the float bowl. Upon sensing a higher vacuum level, the valve moves to an open position which allows the vacuum in the carburetor throat to be communicated to the air space in the float bowl.

8 Claims, 1 Drawing Sheet

VALVE CONTROL FOR BACK DRAFT CARBURETOR

BACKGROUND OF THE INVENTION

The present invention relates to a back draft carburetor of the type in which a vacuum source in the throat of the carburetor is communicated to the air space above the fuel in the float bowl of the carburetor and more particularly to valve control that alternately opens and closed the passageway connecting the vacuum source to the float bowl.

Back draft carburetors of the type shown in U.S. Pat. No. 4,040,399 apply a vacuum created by a venturi effect of the throttle valve within the throat of the carburetor to the air space above the fuel in the float bowl. This application of a vacuum to the air space above the fuel in the carburetor bowl enhances the fuel economy of the engine. It has been found that with systems of this type, that the engine will go lean to the point of not running at low engine RPM's and large throttle openings. The problem has been overcome by calibrating a progression system so that the engine would run rich. However, when the RPM's would increase with the same large throttle opening, the engine would be richer than it need be, thus, fuel economy benefits were lessened. This situation was basically caused by the fact that once the back draft hole in the throttle bore is uncovered, systems such as that shown in the U.S. Pat. No. 4,040,399 patent were always operable, thus, causing the engine to run leaner than it would if the back draft system was disconnected.

The object of the present invention is to make the back draft system inoperable at low engine RPM's and large throttle openings so that the vacuum in the throat of the carburetor will not be communicated to the air space above the fuel in the float bowl. This will prevent the engine from running lean and stopping and yet permit back draft operation at higher engine RPM's so that the fuel economy benefits are retained.

SUMMARY OF THE INVENTION

A back draft carburetor of the type in which a vacuum source in the throat of the carburetor is communicated to the air space above the fuel in the float bowl of the carburetor includes a valve disposed between the vacuum source and the float bowl.

In accordance with one aspect of the invention, the valve is responsive to the vacuum in the carburetor throat so that when a sufficient vacuum has built up in the carburetor throat, the valve will move to an open position so that the vacuum can be communicated to the air space above the fuel in the float bowl.

In accordance with yet another aspect of the invention, the valve includes a biasing member which urges the valve to its closed position in which the vacuum in the carburetor is sealed off from the float bowl.

In accordance with yet another aspect of the invention, the valve includes a housing having a first port communicating with the vacuum source and a second port communicating with the air space above the fuel in the float bowl. A sealing member is disposed for slidable movement within the housing between a closed position in which communication between the first and second ports is prevented and an open position in which communication between the ports is allowed.

The present invention thus makes the back draft system inoperable at low vacuums in the carburetor. These low vacuum conditions are generally associated with low RPM's and large throttle openings in which it would be desirable to have the engine run rich. By making the back draft system inoperable, the air pressure above the fuel in the float bowl remains at or near atmospheric pressure, thus, allowing the engine to run rich.

BRIEF DESCRIPTION OF THE DRAWINGS

The drawing illustrates the best mode presently contemplated of carrying out the invention.

In the drawings.

DESCRIPTION OF THE PREFERRED EMBODIMENT

Figure 1:
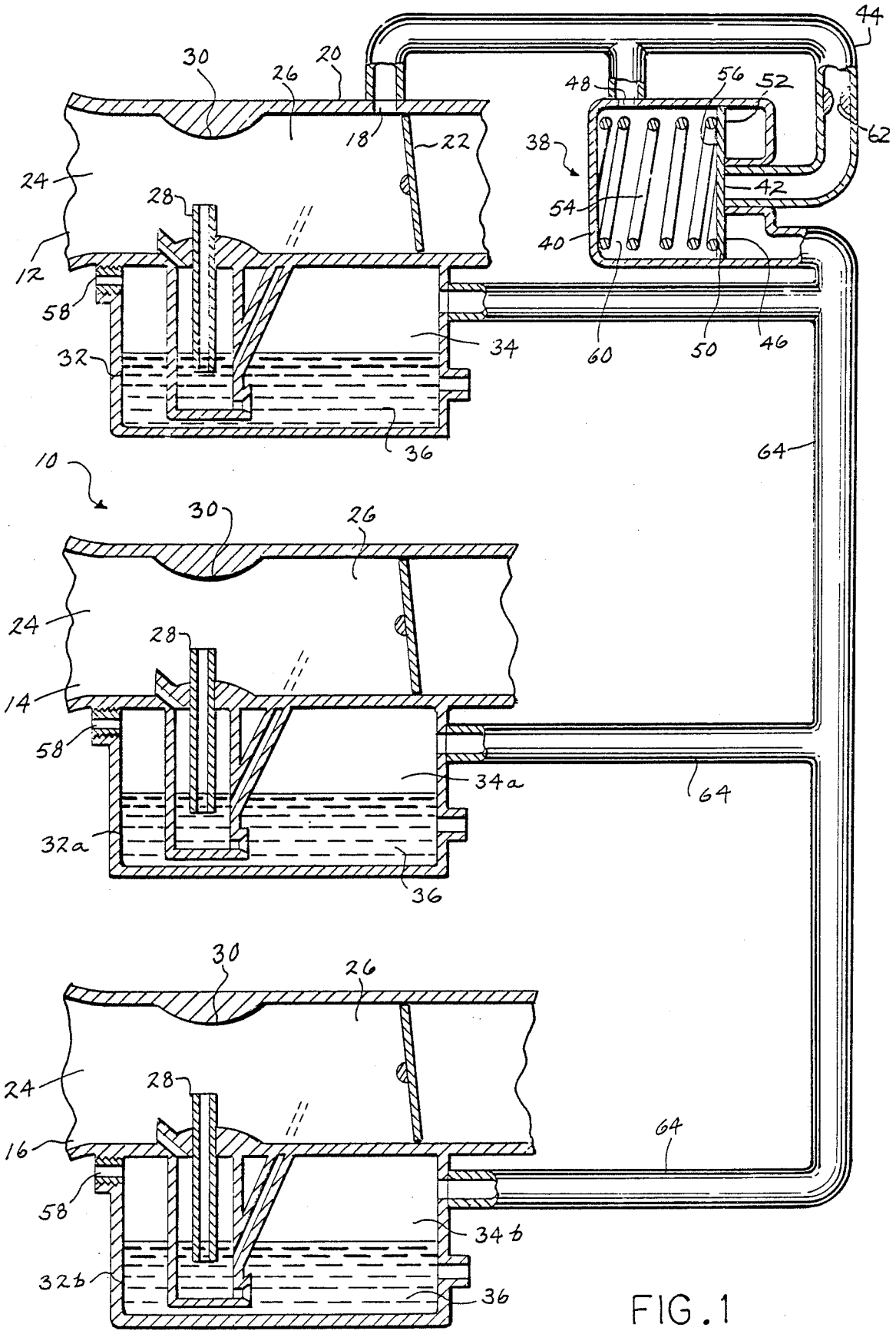
FIG. 1 is a side cross sectional view of a multi-carburetor fuel system constructed according to the invention.

FIG. 1 illustrates a multi-carburetor fuel system 10 employing carburetors 12, 14 and 16.

Carburetor 12 is a back draft carburetor of the type shown in U.S. Pat. No. 4,040,399. In carburetors of this type, a port 18 is provided in carburetor wall 20 adjacent throttle plate 22.

The remaining structure of carburetor 12 (and carburetors 14 and 16) is typical in that it includes an intake 24, a throat 26 and a main nozzle 28 that introduces fuel into venturi 30 from float bowl 32. As throttle plate 22 pivots across port 18, a venturi effect vacuum is created and in systems such as that shown in the U.S. Pat. No. 4,040,399, this vacuum would be communicated directly to the air space 34 above the fuel 36 in float bowl 32.

In the present invention, a valve 38 is disposed between port 18 and air space 34. Valve 38 includes a housing 40 having a first port 42 that commumicates with port 18 by means of conduit 44.

Housing 40 further includes a second port 46 that communicates with air space 34 in float bowl 32.

Housing 40 is also provided with a third port 48 that also communicates with the vacuum source via port 18.

A sealing member or diaphragm 50 is slidably disposed within housing 40 and has a first side 52 that is biased into a sealing engagement with ports 42 and 46 by means of a spring 54 that acts on a second side 56 of sealing member 50.

Air space 34 is at or near atmospheric pressure due to the fact that it is vented by means of vent hole 58. Thus, the air pressure at port 46 is at or near atmospheric pressure while the air pressure in spring chamber 60 is below atmospheric pressure due to the fact that third port 48 connects spring chamber 60 with the vacuum source via port 18.

In operation, when the venturi effect vacuum in carburetor throat 26 reaches a sufficient level, the air pressure at second port 46 will overcome the biasing effect of spring 54 and sealing member 50 will move to a position left of that shown in FIG. 1 so that it is no longer in engagement with ports 42 and 46. In this position, the vacuum in carburetor throat 26 will be communicated to air space 34 in float bowl 32 and the back draft effect will take effect.

Conduit 44 is provided with a restriction 62 which will cause a pressure drop in conduit 44 as air flows from float bowl 32 to carburetor throat 26. This pressure drop further accentuates the pressure differential between ports 42 and 46 and spring chamber 60 so as to maintain valve 38 in its open position.

In the multi-carburetor system shown in FIG. 1, additional carburetors 14 and 16 have their float bowl air spaces communicating with port 46 by means of passageway 64. Thus, when valve 38 moves to its open position, the vacuum in carburetor throat 26 will not only be communicated to the air space in float bowl 32 of carburetor 10 but also to the air spaces 34*a* and 34*b* in float bowls 32*a* and 32*b* in carburetors 14 and 16. Thus, the back draft effect can be accomplished in a multi-carburetor system with only one of the carburetor having the necessary port 18 machined into the carburetor housing.

The present invention thus provides a valving system that effectively makes the back draft effect inoperable at low vacuum levels such as those that would be present in a low RPM high throttle opening situation, thus, allowing the engine to run richer than it would if the back draft were in effect.

It is recognized that various alternatives and modifications are possible in the scope of the appended claims.

I claim:

1. In a back draft carburetor of the type in which a vacuum source in the throat of the carburetor adjacent the upstream edge of the throttle valve is communicated to the air space above the fuel in the float bowl of the carburetor, a back draft control comprising:

a housing having a first port communicating with the vacuum source and a second port communicating with the air space above the fuel in the float bowl, a sealing member disposed for slideable movement within said housing between a closed position in which communication between said first and second ports is prevented and an open position in which communication between said first and second ports is allowed, and biasing means urging said sealing member to said closed position, said sealing member being responsive to the vacuum level so that upon sensing a sufficient vacuum in the carburetor throat said sealing member overcomes said biasing means and moves to said open position.

2. The back draft control defined in claim 1 further comprising:

at least one additional carburetor of the type having a float bowl and a passageway connecting the air space above the fuel in the float bowl of said additional carburetor with said valve means so that when said valve moves to said open position the vacuum in the throat of the first carburetor is communicated to the float bowl of said first carburetor and said additional carburetor.

3. The back draft control defined in claim 1 further comprising a conduit connecting said first port to the vacuum source with said conduit having a restricted portion causing a pressure drop in said conduit when air flows through said conduit toward the vacuum source.

4. The back draft control defined in claim 3 further comprising at least one additional carburetor of the type having a float bowl and a passageway connecting the air space above the fuel in the float bowl of said additional carburetor with said valve means so that when said valve moves to said open position the vacuum in the throat of the first carburetor is communicated to the float bowl of said first carburetor and said additional carburetor.

5. The back draft control defined in claim 1 wherein said sealing member has first and second sides and said first and second ports are disposed so as to be engaged by one of said sides when said valve is in said closed position and said biasing means acting on the other side of said sealing member and urging said sealing member into engagement with said first and second ports.

6. The back draft control defined in claim 5 further comprising:

at least one additional carburetor of the type having a float bowl and a passageway connecting the air space above the fuel in the float bowl of said additional carburetor with said second port so that when said valve moves to said open position the vacuum in the throat of the first carburetor is communicated to the float bowl of said first carburetor and said additional carburetor.

7. The back draft control defined in claim 5 further comprising a third port in said housing communicating with the vacuum source and disposed on the biasing means side of the sealing member so that upon achieving a predetermined vacuum level in the carburetor throat the air pressure at said second port overcomes said biasing means to move said sealing member out of engagement with said first and second ports and allow communication between said first and second ports.

8. the back draft control defined in claim 7 further comprising at least one additional carburetor of the type having a float bowl and a passageway connecting the air space above the fuel in the float bowl of said additional carburetor with said valve means so that when said valve moves to said open position the vacuum in the throat of the first carburetor is communicated to the float bowl of said first carburetor and said additional carburetor.

* * * * *